United States Patent [19]

Sato et al.

[11] Patent Number: 4,838,218

[45] Date of Patent: Jun. 13, 1989

[54] CERAMIC VALVE SUPPORTING STRUCTURE IN USE FOR INTERNAL COMBUSTION ENGINE

[75] Inventors: Yasushi Sato; Shigeru Nagasaki; Masato Taniguchi; Junichi Kagawa; Mitsuyoshi Kawamura, all of Nagoya, Japan

[73] Assignee: NGK Spark Plug Co., Ltd., Nagoya, Japan

[21] Appl. No.: 62,138

[22] Filed: Jun. 12, 1987

[30] Foreign Application Priority Data

| | | | |
|---|---|---|---|
| Jun. 12, 1986 | [JP] | Japan | 61-136737 |
| Jun. 12, 1986 | [JP] | Japan | 61-136738 |
| Jun. 12, 1986 | [JP] | Japan | 61-136739 |
| Jul. 23, 1986 | [JP] | Japan | 61-113280[U] |
| Aug. 21, 1986 | [JP] | Japan | 61-127315[U] |

[51] Int. Cl.[4] ..... F01L 3/10

[52] U.S. Cl. ..... 123/188 AA; 123/90.67

[58] Field of Search ..... 123/188 SC, 188 AA, 123/90.67

[56] References Cited

U.S. PATENT DOCUMENTS

| | | | |
|---|---|---|---|
| 2,633,111 | 3/1953 | Pielstick | 123/90.67 |
| 3,265,053 | 8/1966 | Fitzsimmons | 123/90.67 |
| 3,938,484 | 2/1976 | Mueller | 123/90.67 |
| 4,180,030 | 12/1979 | McWhirter | 123/90.67 |
| 4,359,022 | 11/1982 | Nakamura et al. | 123/188 AA |

*Primary Examiner*—Willis R. Wolfe
*Assistant Examiner*—M. Macy
*Attorney, Agent, or Firm*—Cooper & Dunham

[57] ABSTRACT

A ceramic valve supporting structure for use in an internal combustion engine comprising: a ceramic valve having an integral stem, an upper portion of which is provided with a circular groove therearound; a frustoconical shaped cotter comprising a pair of semi-cylindrical pieces, each inner surface of which has a lock projection located within said groove when secured to an outer surface of said stem; an annular retainer secured to an outer surface of said cotter to support said valve through said cotter, said retainer having an inner surface tapered to engage the outer surface of said cotter by wedging action due to a spring force acting upon to said retainer to bring said cotter into tight engagement with said stem; and an elastic layer provided between an inner surface of said cotter and the outer surface of said stem to absorb stress when said cotter engages said stem.

20 Claims, 16 Drawing Sheets

CERAMIC VALVE SUPPORTING STRUCTURE IN USE FOR INTERNAL COMBUSTION ENGINE

BACKGROUND OF THE INVENTION

1. Field of the Invention

This invention relates to a ceramic valve which in turn moves to open and close an intake and exhaust port of an engine cylinder, and particularly concerns to an improved structure to movably support a ceramic valve.

2. Description of the Prior Art

In recent years, high rotation with high power has been required for an internal combustion engine in use for an automobile. A valve, adapted to open and close an intake and exhaust port of an engine cylinder, is exposed to severe environment both mechanically and thermally. Light weight and heat-resistant ceramics is considered to apply to the valve so as to endure the severe environment.

In this instance, a valve (b) supports its stem (s) by a retainer (r) through a cotter (c) as seen in FIG. 14*a*. The outer surface of the cotter (c) and the inner surface of the retainer (r) are both tapered to tightly engage each other by the action of wedge.

In accompaniment with the valve action, the cotter (c) acts to engage with the stem (s) more tightly by the effect of wedge, the maximum intensity of which works at the lowest end (n) of the retainer (r). The retainer (r) makes its end (n) tightly act to the stem (s) through the lowest end (m) of the cotter (c), leading to stress concentration at the stem (s) so as to result in crack or breakage as seen at denotation (k) in FIG. 14*a*.

Another problem is shown by the prior structure, in which the cotter (c) provides a lock projection (p) semicircular in section at the inner surface to interfit an annular groove (g) provided at the outer surface of the stem (s) as shown in FIG. 7*c*.

In association with the action of the valve (b), the projection (p) acts to tightly engage with the open ended portion of the groove (g), thus leading to establish stress concentration so as to end up in crack or breakage as seen at denotation (k) in FIG. 7*c*.

In addition, with the axial displacement of the valve (b), the cotter (c) comes to engage with the stem (s) more tightly under the influence of wedge effect. The lengthwise sharp edge (e) of each piece tightly engages with the outer surface of the stem (s) so as to cause stress concentration, resulting in crack or breakage as seen at denotation in FIG. 7*d*.

Therefore, it is an object of this invention to provide a ceramic valve supporting structure which is capable of preventing stress concentration from being developed upon a valve stem in a structure in which the ceramic valve is supported by way of a cotter.

It is another object of this invention to provide a ceramic valve supporting structure which is capable of obtaining a long servicing life with simple structure and minimum cost.

According to this invention, there is provided a ceramic valve supporting structure comprising a ceramic valve having an integral stem, the upper portion of which is provided with a circular groove in concentrical relationship with said stem, and arranged to axially displace so as to alternately open and close an intake and exhaust passageway communicating with a combustion chamber of an internal combustion engine, a cotter the outer surface of which is tapered, and formed by butting a pair of semi-cylindrical pieces, and having a lock member placed into said groove when secured concentrically to the outer surface of said stem, a cylindrical retainer concentrically secured to the outer surface of said cotter so as to support said valve through said cotter, said retainer being provided with the inner surface tapered in a direction so as to make said cotter tightly engage with the outer surface of said stem by means of wedge effect against said tapered cotter due to the urging force of a spring member axially exerted on said retainer, and a stress relief means provided so as to avoid the predetermined portion of said cotter from locally engaging against the outer surface of said stem.

BRIEF DESCRIPTION OF THE DRAWINGS

For a better understanding of the invention and to show how the same may be carried into effect, reference will now be made, by way of example, to the accompanying drawings in which:

FIGS. 1*a* through 4*a* shows first embodiment of the invention in which;

FIG. 1*a* is a longitudinal cross sectional view of main component of a valve supporting structure;

FIG. 4*a* is a partial view of an internal combustion engine associated with the invention;

FIGS. 5*a* through 8*a* are views of main part of supporting structure according to second through fifth embodiments of the invention;

FIGS. 5*b* through 7*b* are longitudinal cross sectional views of a main views of a main component according to twelfth through fourteenth embodiments of the invention;

PREFERRED EMBODIMENTS OF THE INVENTION

Each embodiment of the invention is described hereinafter in reference with the drawings.

Figure 1A:
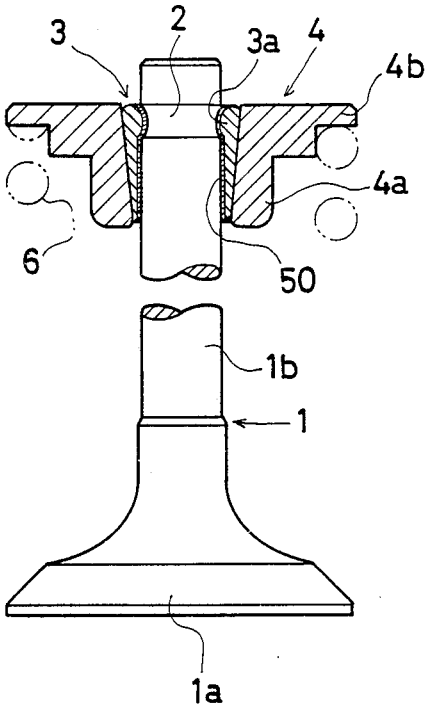
Figure 1B:
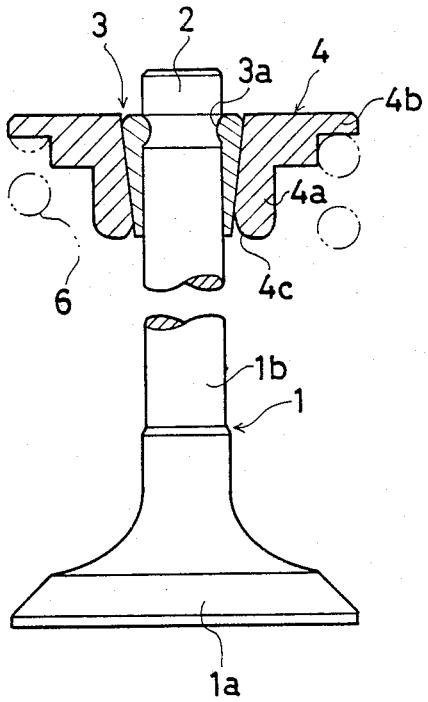
FIG. 1*b* is a view similar to FIG. 1*a* according to eleventh embodiment of the invention.
Figure 2A:
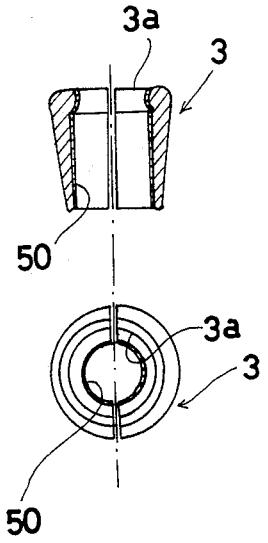
FIG. 2*a* is a longitudinal cross sectional view of a cotter.
Figure 3A:
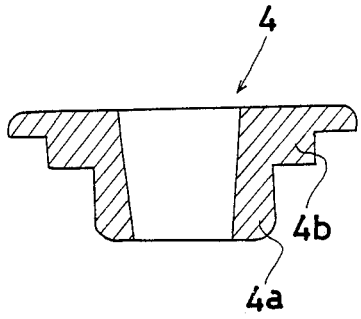
FIG. 3*a* is a longitudinal cross sectional view of a retainer.
Figure 3B:
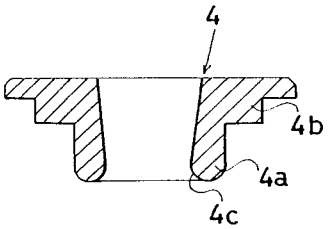
FIG. 3*b* is a longitudinal cross sectional view of a retainer according to eleventh embodiment of the invention.

In a first embodiment of the invention, an exhaust valve 1, which is employed in a combustion chamber of an internal combustion engine described hereafter, is made of ceramics such as silicon nitride material, and has a column-shape stem 1*b* formed in integrally with a valve head 1*a* as shown in FIG. 1*a*. The valve 1 provides a circumferential groove 2 semi-circular in section with the upper portion of the stem 1*b*. A metallic cotter 3 comprising a pair of split pieces, substantially forms a cylinder when combined as seen in FIG. 2*a*.

Into the stem 1*b* of the valve 1, is the cotter 3 telescoped, the inner surface of which has an integral lock projection 3*a* semi-circular in section placed into the groove 2. A retainer 4 which is comprised a cylindrical portion 4*a* and a flange 4*b* formed in integral with the top of the portion 4*a*, is interfit into the outer surface of the cotter 3 through the cylindrical portion 4*a*. In this instance, the retainer 4 provides a tapered inner surface with the cylindrical portion 4*a* to make face-to-face contact with an oppositely tapered outer surface of the cotter 3.

Now, attention is called to a heat-resistant portion designated at 50 which serves as a stress-relief layer coated to the inner surface of the cotter 3. The stress relief layer 50 is not less than at least 5 micron at its thickness which is formed by means of electrical plating of metal such as nickel, copper, silver or the like. Instead of the plating, such means as fluorine-based plastic coating or spattering may be employed to form a layer 50.

With above structure, the cotter 3 engages with the stem 1*b* through the stress-relief layer 50.

Figure 4A:
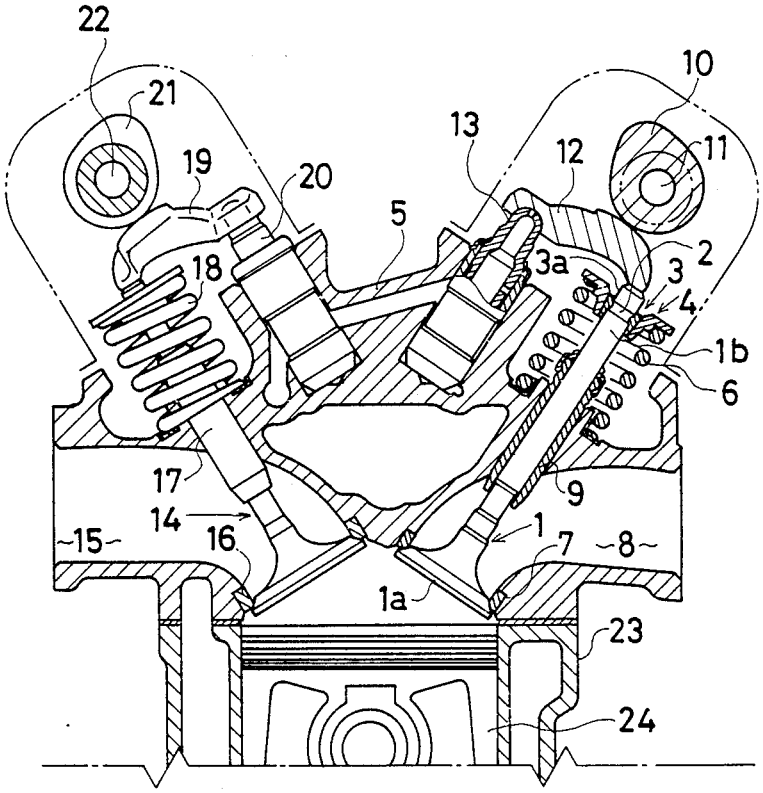

The valve 1 thus far described, is incorporated into a cylinder head 5 of an internal combustion engine as shown in FIG. 4*a*. Between the valve 1 and the cylinder head 5, is a compression coil spring 6 provided to urge the valve 1 upward in the axial direction so as to airtightly close an exhaust passage 8 by the engagement of the valve head 1*a* against a valve seat 7.

With the engine running, the valve 1 repeatedly displaces upward and downward to alternately close and open the exhaust passage 8. In compliance with the up-and downward displacement of the valve 1, the retainer 4 tightly engages with the cotter 3 through each tapered surface by means of wedge effect. This causes the cotter 3 to tightly engages against the outer surface of the stem 1*b* through the stress-relief layer 50. In this situation, the layer 50 approprietely deforms itself according to the stress from the cotter 3, so that the cotter 3 uniformly engages against overall inner surface of the stem 1*b* through the layer 50. This avoids the upper end of the cotter 3 from locally enaging against the stem 1*b* so as not to undergo stress concentration, leading to conducive to a long servicing life, in opposition to the counterpart supporting structure in which stress concentration applied on a stem may result in crack or breakage.

In addition, all required to avoid the stress concentration upon the stem 1*b* is only the stress relief layer 50 so as to substantially maintain a simple and cost-saving structure. To take an example as a layer, it is found that a copper plating of 15 micron thick renders immune to crack or breakage even at an excessively high revolution range of the engine.

In further reference with the drawings of FIG. 4*a*, numeral 9 designates a tubular guide to receive the stem ib of the valve 1, numeral 10 designates a cam connected to a shaft 11, numeral 12 being a swing arm, one end of which engages against the upper end of the stem 1*b*, while the other end of which is supported by a spherical support 13. The rotation of the cam 10 causes to oscillate the swing arm 12 so as to axially displace the stem 1*b*. Numeral 14 designates an intake valve which acts to alternately open and close an air-intake passage 15 through a valve seat 16. Numeral 17 designates a valve guide, numeral 18 a compression coil spring, numeral 19 a swing arm, one end of which engages against the upper end of a valve 14, while the other end is supported by a spherical support 20. Numeral 21 designates a cam connected to a shaft 22, and rotation of the cam 21 causes the swing arm 19 to oscillate so as to axially displace the valve 14. Numeral 23 designates a cylinder block, numeral 24 being a piston which lengthwisely reciprocates within the cylinder block 23 in a conventional manner.

Now, the second through fifth embodiment of the invention is described in reference with the drawings of FIGS. 5*a* through 8*a*.

Figure 5B:
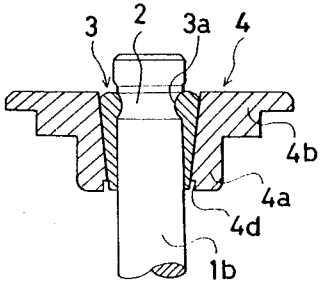
Figure 2C:
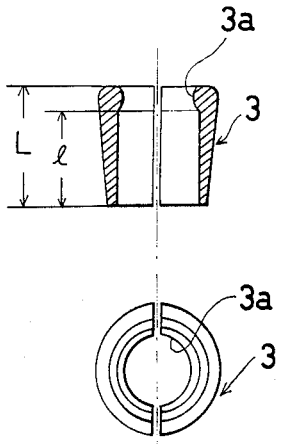
FIG. 2*c* is a longitudinal cross sectional view of a cotter according to fifteenth embodiment of the invention.
Figure 3C:
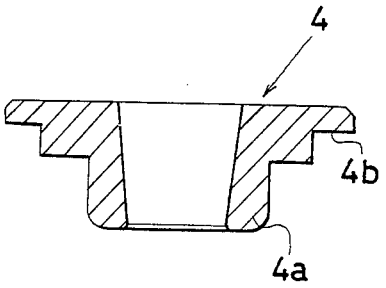
FIG. 3*c* is a cross sectional view of a retainer according to fifteenth embodiment of the invention.
Figure 5C:
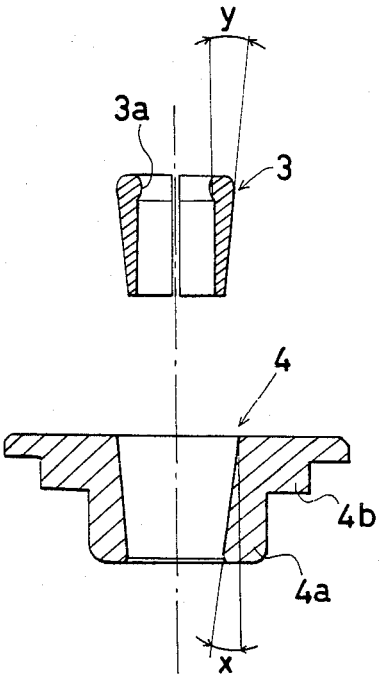
FIG. 5*c* is an exploded cross sectional view of a valve supporting structure according to sixteenth embodiment of the invention.
Figure 5D:
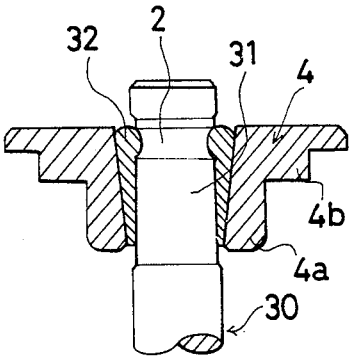
FIGS. 5*d* and 6*d* are cross sectional views of a valve supporting structure according to eighteenth and nineteenth embodiment of the invention.
Figure 5A:
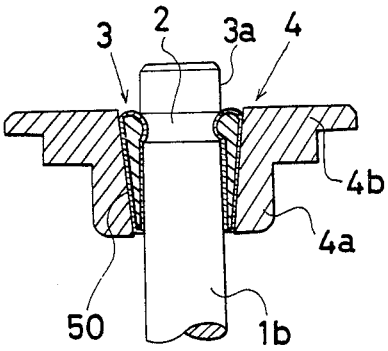

In the second embodiment at FIG. 5*a*, the stress relief layer 50 is provided with overall outer surface of the cotter 3.

Figure 6B:
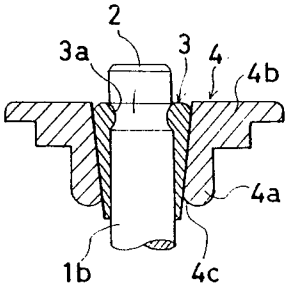
Figure 6C:
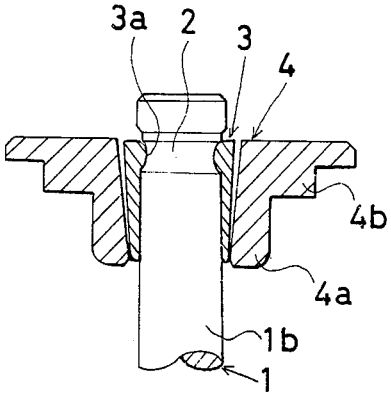
FIG. 6*c* is a longitudinal cross sectional view of a valve supporting structure according to sixteenth embodiment of the invention.
Figure 2D:
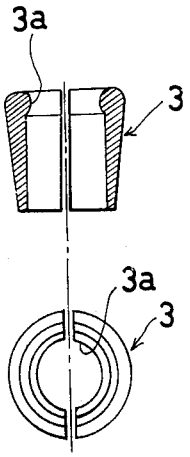
FIG. 2*d* is a cross sectional view of a cotter according to seventeenth embodiment of the invention according to seventeenth embodiment of the invention.
Figure 3D:
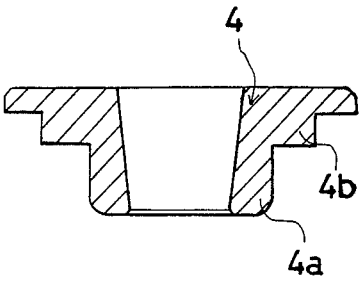
FIG. 3*d* is a cross sectional view of a retainer according to seventeenth embodiment of the invention.
Figure 6D:
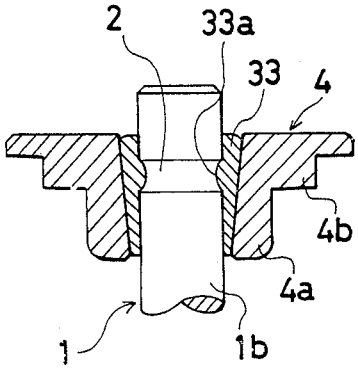
Figure 6A:
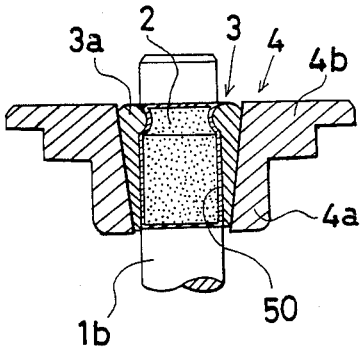

In the third embodiment at FIG. 6*a*, the stress relief layer 50 is provided with the outer surface of the stem 1*b* instead of the cotter 3.

Figure 7B:
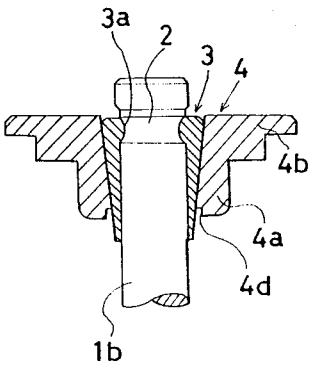
Figure 2B:
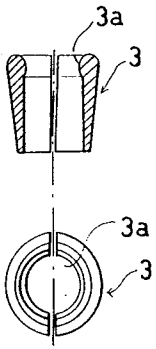
FIG. 2*b* is a logitudinal cross sectional view of a cotter according to eleventh embodiment of the invention.
Figure 7A:
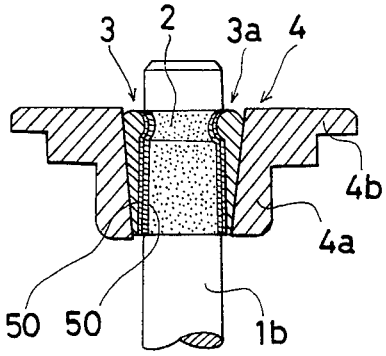

In the fourth embodiment at FIG. 7*a*, the stress relief layer 50 is provided with the stem 1*b* as of FIG. 6*a* in addition to the cotter 3 of the first embodiment.

Figure 8A:
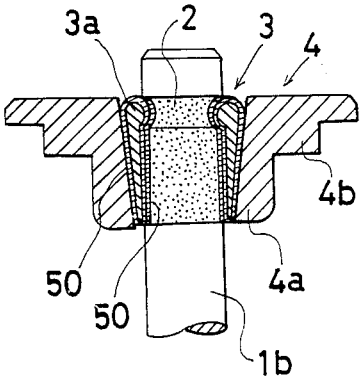

In the fifth embodiment at FIG. 8*a*, the stress relief layer 50 is provided with the cotter 3 in a manner similar to the second embodiment in addition to the stem 1*b* of the third embodiment.

Figure 9A:
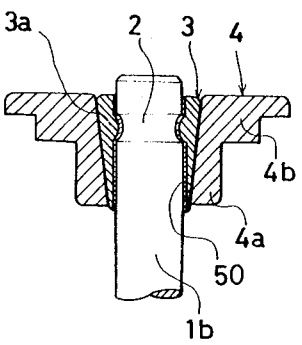
FIG. 9*a* is a view similar to FIGS. 5*a* through 8*a* according to sixth embodiment of the invention.
Figure 13A:
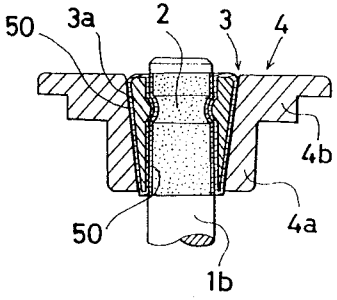
FIG. 13*a* is a view similar to FIGS. 5*a* throguh 8*a* according to tenth embodiment of the invention.
Figure 12A:
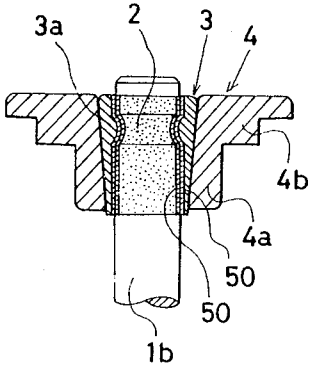
FIG. 12*a* is a view similar to FIGS. 5*a* through 8*a* according to nineth embodiment of the invention.
Figure 14A:
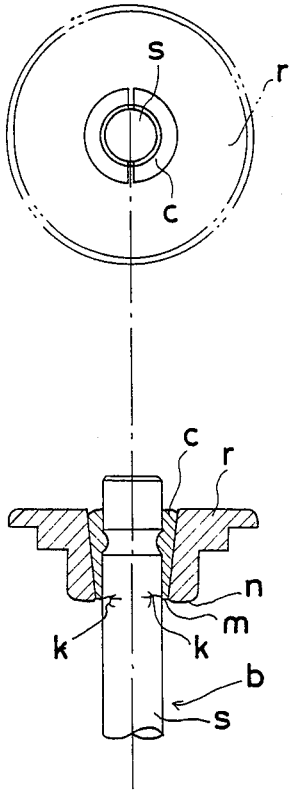
Fig.14a PRIOR ART

Now, the sixth through tenth embodiment of the invention respectively is shown in FIGS. 9*a* through 13*a*. In the sixth through tenth embodiment, the cotter 3 has the lock projection 3*a* positioned somewhat remote from the upper end toward the central portion, and each modified to correspond to the first through fifth embodiment. That is to say, the sixth embodiment of FIG. 9*a* shows the stress relief layer 50 provided with the inner surface of the cotter 3. The seventh embodiment of FIG. 10*a* shows the same layer 50 provided with the inner and outer surface of the cotter 3. The eighth embodiment of FIG. 11*a* shows the layer 50 provided with the stem 1. The nineth embodiment of FIG. 12*a* shows the layer 50 provided with the inner surface of the cotter 3 in addition to the stem 1. The tenth embodiment of FIG. 13*a* shows the layer 50 provided with the inner and outer surface of the cotter 3 in addition to the stem 1.

In the second through tenth embodiment, the reference numerals corresponding to components being identical to those in the first embodiment, and only the structural parts other than those in the first embodiment is described.

It is noted that the case in which the layer 50 is provided with overall surface of the cotter 3 is preferrable owing to eliminating the need of coating or marking partially.

Further, it is noted that the lock projection 3*a* of the cotter 3 may be rectangular in section instead of semicircular section. In this case, the groove 2 of the stem 1 corresponds to the shape of the lock projection 3*a*.

In addition, the stress relief layer 50 is not limited only to metal such as nickel, copper, silver or the like instead of those material, the layer 50 may be made of such materials as to be elastically expansible and developable, at the same time, heat-resistant.

Referring to FIGS. 1*b* through 3*b*, eleventh embodiment of the invention is described hereinafter.

In the eleventh embodiment, instead of the stress-relief layer 50, a novel structure is provided as follows:

That is, the lengthwise dimension of the retainer 4 is determined substantially equal to that of the cotter 3. The retainer 4 has a semi-circularly rounded bevel portion 4*c* in the form of an arch at the lowerest end in the circumferential direction. The bevel portion 4*c* acts as a stress relief means to position slightly remote from the outer surface of the cotter 3 so as to be in non-contacting relationship with the lower end of the cotter 3.

According to the eleventh embodiment, the bevel portion 4*c* effectively avoids it from tightly engaging against the lower end of the cotter 3, thus leading to a long service life, in opposition to the counterpart supporting structure in which stress concentration applied to a stem may result in crack or breakage.

Attention is called to the drawings of FIG. 5*b* in which twelfth embodiment of the invention is shown.

In the twelfth embodiment, instead of the bevel portion 4*c* of the eleventh embodiment, the retainer 4 provides a circumferentially notched portion 4*d* at the lowest inner side to position slightly remote from the outer surface of the cotter 3 so as to be in non-contacting relationship with the lower end of the cotter 3.

Attention is called to the drawings of FIGS. 6*b* and 7*b* in which thirteenth and fourteenth embodiment are respectively shown.

In the thirteenth embodiment of FIG. 6*b*, the cotter 3 determines its lower end greater in length than that of the eleventh embodiment so as to somewhat extend downward beyond the lower end of the retainer 4.

In the fourteenth embodiment of FIG. 7*b*, the cotter 3 determines its lower end greater in length than that of the twelfth embodiment in a similar manner as above so as to somewhat extend downward beyond the lower end of the retainer 4.

Figure 1C:
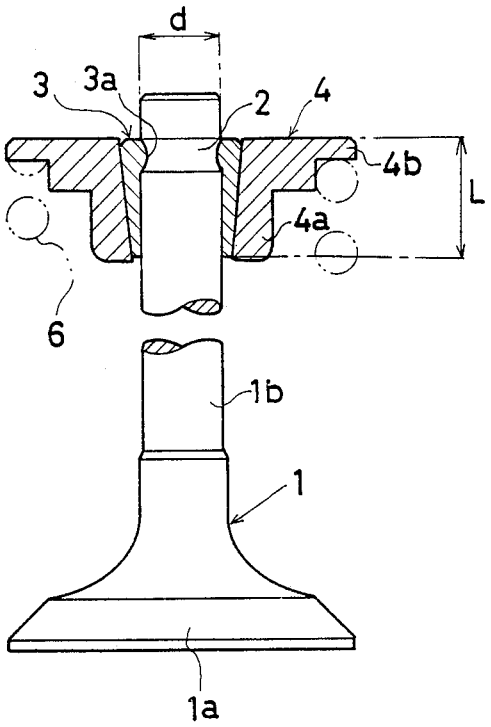
FIG. 1*c* is a view similar to FIG. 1*a* according to fifteenth embodiment of the invention.

Now, attention is called to FIG. 1*c* in which fifteenth embodiment of the invention is shown. In the fifteenth embodiment, the cotter 3 determines its lengthwise dimension (L) 1.4 times as great as the diametric dimension (d) of the stem 1*b* as seen in FIG. 1*c*.

In this instance, the lengthwise dimension (L) of the cotter 3 may fall within an extent ranging from 1.1 times to 1.5 times greater than the diametric dimension (d) of the stem 1*b*.

Such is the dimensional arrangement between the cotter 3 and the stem 1*b*, that the lengthwise dimension (l) in which the cotter 3 substantially contacts against the stem 1*b* is determined to fall within an extent ranging from 0.6 times to 1.1 times greater than the diametric dimension (d) of the stem 1*b*.

According to the embodiment of the invention, the lengthwise dimension (L) of the cotter 3 is 1.4 times greater than the diametrical dimension (d) of the stem 1*b*, so that the cotter 3 brings its inner surface uniformly into engagement with overall outer surface of the stem 1*b*, in opposition to the counterpart in which a cotter tightly engages its lock projection against the open ended portion of a groove to result in stress concentration.

Experimentation conducted with the stem 5.5 mm in diameter (d), the cotter 7.8 mm in length (L), the contacting length (l) 6 mm and with the valve made of ceramic material such as, for example, silicon nitride ($Si_3N_4$), shows that no crack or no breakage was found on the valve with the revolution range from $1.0\times10^4$ rpm idling to $1.2\times10^4$ rpm racing at full load.

Further, attention is called to FIGS. 5*c* and 6*c* in which sixteenth embodiment of the invention is shown. In this embodiment, such is the arrangement between the cotter 3 and the retainer 4 that the cotter 3 determines the tapered degree (y) slightly smaller than that (x) of the retainer by an angle of such as, for example, 0.5 degrees. Such arrangement allows to lessen the engagement degree of the projection 3*a* against the open-ended portion of the groove 2, so that overall inner surface of the cotter 3 uniformly engages with the outer surface of the stem 1*b*, thus preventing the projection 3*a* from locally engaging against the open-ended portion of the groove 2 so as to avoid stress concentration.

It is noted that the angular difference between tapered degree of the cotter 3 and that of the retainer 4 should be 0.7 degree at most, taking the wedge effect into consideration.

Figure 1D:
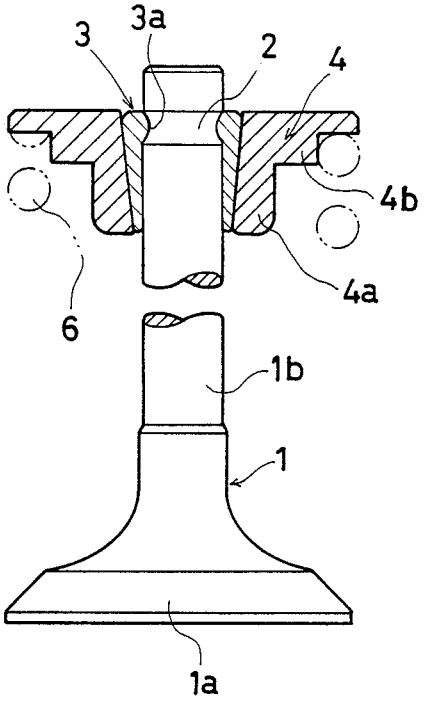
FIG. 1*d* is a view similar to FIG. 1*a* according to seventeenth embodiment of the invention.

Attention is also called to FIG. 1*d* in which seventeenth embodiment is shown. In this embodiment, the cotter 3 determines its inner diameter slightly greater than the outer diameter of the stem 1*b* by the length of such as, for example, 0.08 mm.

Figure 7C:
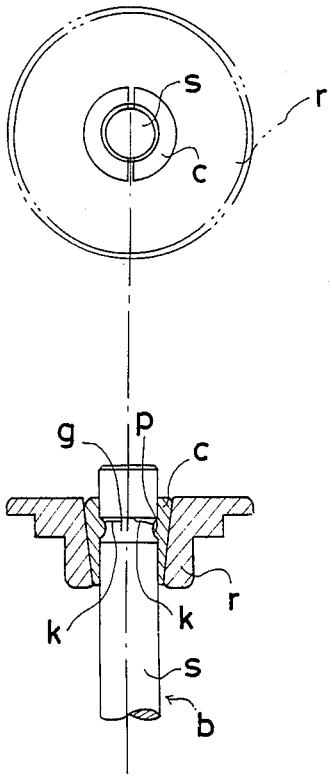
Fig.7c PRIOR ART
FIG. 14*a*, FIG. 7*c* and FIG. 7*d* are each cross sectional view and plan view of prior art valve supporting structure.
Figure 7D:
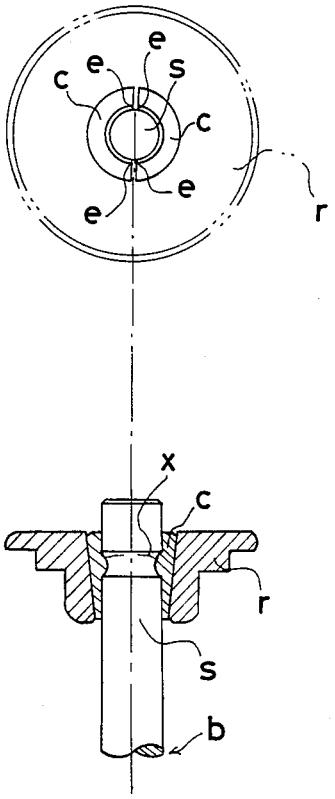
Fig.7d PRIOR ART
Figure 11A:
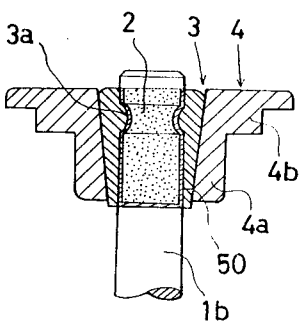
FIG. 11*a* is a view similar to FIGS. 5*a* through 8*a* according to eighth embodiment of the invention.
Figure 10A:
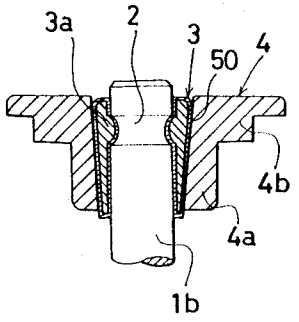
FIG. 10*a* is a view similar to FIGS. 5*a* through 8*a* according to seventh embodiment of the invention.

Such is the structure of the seventeenth embodiment that the cotter 3 brings its overall inner surface into uniform engagement with the outer surface, thus avoiding stress concentration, in opposition to the counterpart of FIG. 7*d* in which the lengthwise sharp edge tightly engages with the stem.

Attention is called to FIG. 5*d* in which eighteenth embodiment of the invention is shown. In this embodiment, a valve 30 slightly reduces the diameter of the stem 31 to be smaller than the inner diameter of a cotter 32 by the length of between 0.01 and 0.08 mm, in opposition to the seventeenth embodiment in which the cotter 3 increases its diameterical dimension to be greater than the diameter of the stem 1*b*.

Attention is also paid to FIG. 6*d* in which nineteenth embodiment of the invention is shown. In this embodiment, a cotter 33 provides a lock projection 33*a* somewhat remote from its upper end toward the central portion.

Figure 1E:
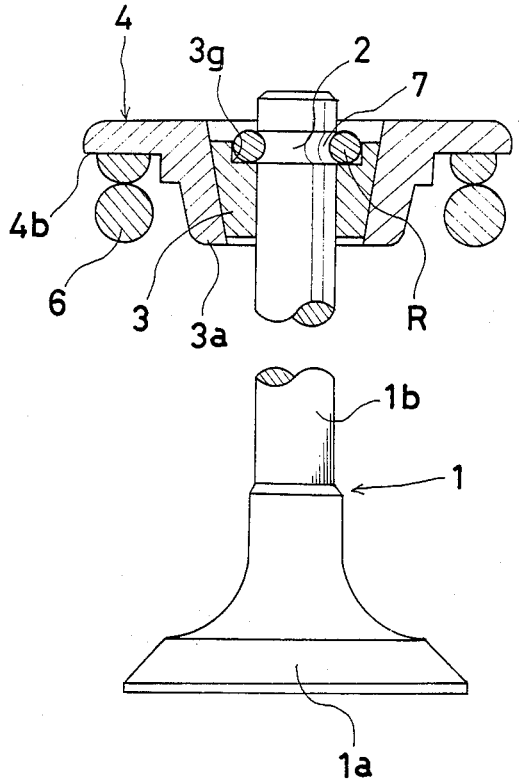
FIG. 1*e* is a view of valve similar to FIG. 1*a* according to twentieth embodiment of the invention.
Figure 2E:
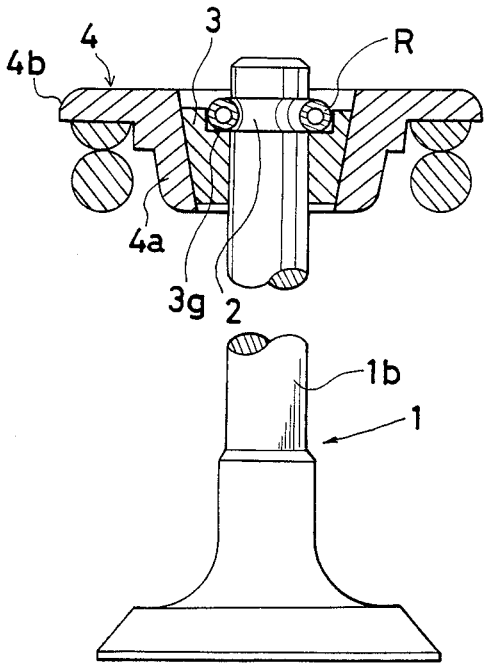
FIG. 2*e* is a view similar to FIG. 1*a* according to the twentyfirst embodiment of the invention.

Referring to FIGS. 1*e* and 2*e* in which twentieth and twentyfirst embodiment of the invention are shown. In the twentieth embodiment of FIG. 1*e*, the cotter 3 provides a groove 3*g* in corresponding with the groove 2 of the stem 1*b*, instead of the projection 3*a* of preceding embodiments. A circular solid ring R fits the inner circumference portion into the groove 2 of the stem 1*b* while outer circumference portion into the groove 3*g* of the cotter 3, so that the cotter 3 support the valve 1 through the ring R. The ring R may preferably be made from titanium or titanium-based alloy which has small Young's modulus of 11,000 kg/mm$^2$, compared to that of conventional metal of 21,000 kg/mm$^2$.

According to the twentieth embodiment, the ring R elastically deforms to effectively absorb the engagement force of the cotter 3 against the stem 1*b*, thus avoiding tight engagement against the open-ended portion of the groove 2.

Experimentation conducted with the cotter 3 from SCM 435, the ring R from 99% titanum, and the valve 1 from 94% sintered silicon nitride, shows no crack or no breakage was found on the valve 1 with the revolution range from idling rpm to $1.2\times10^4$ rpm racing at the cycle of $2\times10^4$ repeatedly.

Figure 3E:
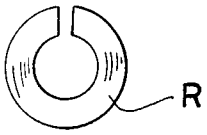
FIG. 3*e* is a plan view of a ring according to modified form of twentieth or twentyfirst embodiment.

Refering to FIG. 2*e*, the twentyfirst embodiment is shown in which the ring R is in the form of hollow to readily deform. Instead of close-looped ring, such open-looped type as seen in FIG. 3*e* may be employed to obtain ready securement to the stem 1*b*.

It is appreciated that the ring R may be made from shape memory alloy to deform reducing the diameter so as to be tightly placed at the groove 2 at the time of high ambient temperature with the engine running.

While various changes may be made in the detail construction, it is understood such manage will be within the spirit and scope of the present invention.

What is claimed is:

1. A ceramic valve supporting structure comprising:

(a) a ceramic valve having an integral stem, an upper portion of which is provided with a circular groove therearound, and arranged to be axially displaced to alternately open and close an intake and exhaust port communicating with a combustion chamber of an internal combustion engine;

(b) a frusto-conical shaped cotter comprising a a pair of semi-cylindrical pieces, each inner surface of which has a lock projection (3*a*) located within said groove when secured to an outer surface of said stem;

(c) an annular retainer secured to an outer surface of said cotter to support said valve through said cotter;

(d) said retainer having an inner surface tapered to engage said outer surface of said cotter by wedging action by spring force upon said retainer to bring said cotter into tight engagement with said stem; and (e) stress relief means comprising an elastic layer provided at least between an inner surface of said cotter and the outer surface of said stem to absorb stress caused when said cotter locally engages with said stem.

2. A ceramic valve in accordance with claim 1 wherein said stress relief means is a heat-resistant elastic layer coated to the inner surface of said cotter.

3. A ceramic valve in accordance with claim 1 wherein said stress relief means is a heat-resistant elastic layer coated to the outer surface of said stem.

4. A ceramic valve in accordance with claim 1 wherein stress relief means is a heat-resistant elastic layer coated to the inner surface of said cotter and the outer surface of said stem.

5. A ceramic valve supporting structure in accordance with claim 1 wherein said stress relief means has a thickness of not less than about five microns.

6. A ceramic valve supporting structure in accordance with claim 2 wherein said stress relief means has a thickness of not less than about five microns.

7. A ceramic valve supporting structure in accordance with claim 3 wherein said stress relief means has a thickness of not less than about five microns.

8. A ceramic valve supporting structure in accordance with claim 4 wherein said stress relief means has a thickness of not not less than about five microns.

9. A ceramic valve supporting structure as recited in claim 1, in which said stress relief means comprises a beveled portion defined at the lowest inner end of said retainer to provide a slight clearance therebetween in non-contacting relationship with the lowest end of said cotter.

10. A ceramic valve supporting structure as recited in claim 9, in which said beveled portion is in the form of an arch.

11. A ceramic valve supporting structure as recited in claim 9, said beveled portion is in the form of a notch.

12. A ceramic valve supporting structure as recited in claim 1, in which said stress relief means is in the arrangement that the lengthwisely engaging dimension of said cotter against said stem is ranging from not less than 0.6 times of the outer diameter of said stem to not more than 1.1 times thereof.

13. A ceramic valve supporting structure as recited in claim 1, in which the lengthwisely dimension of said cotter is within the range from not less than 1.1 times of the outer diameter of said stem to not more than 1.5 times thereof.

14. A ceramic valve supporting structure as recited in claim 12 or 13, in which the tapered degree of said retainer is substantially equal to that of said cotter, otherwise greater than that of said cotter by the angle of 0.7 degrees at most.

15. A ceramic valve supporting structure recited in claim 1, in which said cotter determines its inner diametrical dimension relatively greater than the outer diameter of said stem with a slight difference.

16. A ceramic valve supporting structure as recited in claim 15 in which the dimensional difference between the inner diameter of said cotter and the outer diameter of said stem, being within the range from 0.01 mm to 0.08 mm.

17. A ceramic valve supporting structure as recited in claim 1, in which said stress relief means comprising: said lock member defined in the form of a circular groove to be in corresponding with the groove of said cotter; and a circular ring made from elastic material, the inner and outer circumference portion of which are placed into the groove of said stem and the groove of said cotter respectively so as to supportingly connect between said cotter and said stem.

18. A ceramic valve supporting structure as recited in claim 17, in which said ring is in the form of open looped doughnut-ring shape.

19. A ceramic valve supporting structure as recited in claim 17, in which said ring is made of titanum or titanum-based alloy.

20. A ceramic valve supporting structure as recited in claim 17, in which said ring is made of shape memory alloy.

* * * * *